US006776301B2

(12) United States Patent
Torres-White et al.

(10) Patent No.: US 6,776,301 B2
(45) Date of Patent: Aug. 17, 2004

(54) CAP WITH ONE-WAY DE-GAS FEATURE

(75) Inventors: Birgitt Torres-White, Hartsville, SC (US); David E. McKnight, Florence, SC (US); Jon Trollen, Cincinnati, OH (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 10/071,132

(22) Filed: Feb. 7, 2002

(65) Prior Publication Data

US 2003/0146216 A1 Aug. 7, 2003

(51) Int. Cl.[7] ..... B65D 51/16

(52) U.S. Cl. ..... 220/203.17; 215/311; 220/203.18; 220/203.29; 220/367.1; 229/215

(58) Field of Search ..... 220/203.03, 203.11, 220/203.16, 203.17, 203.18, 203.29, 366.1, 367.1, 371; 215/311, 308, 307, 320; 426/118; 229/215; 222/554, 548, 546, 562

(56) References Cited

U.S. PATENT DOCUMENTS

| | | | | | |
|---|---|---|---|---|---|
| 1,462,165 | A | | 7/1923 | Buttner | |
| 1,576,763 | A | | 3/1926 | Ingram | |
| 1,773,311 | A | | 8/1930 | Killen | |
| 1,808,702 | A | | 6/1931 | Williams | |
| 1,857,015 | A | | 5/1932 | Gere | |
| 2,160,429 | A | | 5/1939 | Bukolt | |
| 2,198,366 | A | | 4/1940 | Ingram | |
| 2,412,169 | A | | 12/1946 | O'Neil | |
| 2,576,917 | A | | 12/1951 | Benner | |
| 3,331,523 | A | * | 7/1967 | Exton | 215/350 |
| 3,595,467 | A | | 7/1971 | Goglio | |
| 3,799,427 | A | | 3/1974 | Goglio | |
| 3,949,934 | A | | 4/1976 | Goglio | |
| 4,128,184 | A | * | 12/1978 | Northup | 215/222 |
| 4,134,535 | A | * | 1/1979 | Barthels et al. | 383/102 |
| 4,181,146 | A | | 1/1980 | Goglio | |
| 4,210,255 | A | | 7/1980 | Pan | |
| 4,228,914 | A | | 10/1980 | Sanderson | |
| 4,444,219 | A | * | 4/1984 | Hollenstein | 137/246 |
| 4,669,640 | A | * | 6/1987 | Ando et al. | 222/541.5 |
| 4,799,598 | A | | 1/1989 | McFadyen | |
| 4,823,968 | A | | 4/1989 | Handzlik | |
| 4,828,129 | A | | 5/1989 | Jonkers | |
| 4,863,051 | A | | 9/1989 | Eibner et al. | |
| 4,909,434 | A | * | 3/1990 | Jones et al. | 229/125.15 |
| 4,966,780 | A | | 10/1990 | Hargraves et al. | |
| 5,197,620 | A | * | 3/1993 | Gregory | 215/307 |
| 5,348,179 | A | | 9/1994 | Walker | |
| 5,439,724 | A | | 8/1995 | Rojek | |
| 5,515,994 | A | | 5/1996 | Goglio | |
| 5,665,408 | A | * | 9/1997 | Coupe et al. | 426/113 |

(List continued on next page.)

FOREIGN PATENT DOCUMENTS

| | | |
|---|---|---|
| DE | 199 15 907 | 10/2000 |
| EP | 0 659 657 | 6/1995 |

*Primary Examiner*—Robin A. Hylton
(74) *Attorney, Agent, or Firm*—Drinker Biddle & Reath LLP

(57) ABSTRACT

A cap with a way-one valve solves two distinct problems in the field of packaging materials that emit gasses, providing both a means to prevent a package from deforming under pressure built up inside the package, and a means to reseal the package. The cap comprises an inner wall extending downwardly from an inner portion of the top wall to define a cavity. An insert valve is mounted within the cavity, forming a seal with the inside wall. The upper surface of the insert valve, inner wall, and the top wall define a chamber with a gas escape path. A septum is disposed within the chamber, the septum seated on the insert valve and sealing one or more apertures in the insert valve. The septum is capable of at least partially unseating in response to force exerted by increased gas pressure acting through the apertures.

19 Claims, 3 Drawing Sheets

U.S. PATENT DOCUMENTS 5,688,544 A 11/1997 Bolton et al.
5,711,441 A * 1/1998 Adams et al. ..... 215/48
5,806,699 A 9/1998 Ekkert et al.
5,851,608 A * 12/1998 Yamada et al. ..... 428/34.2
5,893,461 A * 4/1999 Walters ..... 206/524.8
5,979,688 A 11/1999 Stodd
6,023,914 A 2/2000 Richison et al.
6,274,209 B1 * 8/2001 Pagidas et al. ..... 428/35.7
6,426,049 B1 * 7/2002 Rosen et al. ..... 422/102
6,468,332 B2 * 10/2002 Goglio et al. ..... 96/134

* cited by examiner

CAP WITH ONE-WAY DE-GAS FEATURE

FIELD OF THE INVENTION

The invention relates to the field of packaging. More specifically, the invention relates to the packaging of gas-emitting foodstuffs.

BACKGROUND OF THE INVENTION

Certain foodstuffs are known to emit gasses. Fresh coffee, for example, gives off significant amounts of carbon dioxide. Thus, producers of gas-emitting foodstuffs are confronted not only with challenges related to the food packaging industry generally, but also with challenges specific to the production of gasses. The present invention solves two problems faced by producers of these specific products, while requiring that only one assembly be added to the packaging.

First, when gas-emitting products are sold in flexible packaging containers, the packaging distorts or pillows as pressure from the emitted gasses increases within the package. A consumer, who is considering purchasing the product, may believe the product is damaged, contaminated, or otherwise unfit. Coffee has been well known to exhibit this complication for a long time.

A second problem faced by producers of gas-emitting consumer products is commonly shared with producers of other foodstuffs, and is the difficulty of providing a means for a consumer to easily open and reseal a package. Conventional flexible packaging techniques rely on the consumer to pull apart a seal at the top of the package in order to open it. This method is not only difficult for the frail or elderly, but is prone to result in product spillage. Further, this conventional technique provides the consumer with no means to reseal the package.

Thus far, a number of solutions to each of these problems have been individually developed by coffee roasters. A known approach to solving the pillowing problem is to hold coffee in a holding bin, allowing the product to de-gas before it is packaged. This method is conventionally performed in preparation for brick-pack packaging. Unfortunately, de-gassing the coffee in the holding bin is more of a compromise than a solution, because the act of holding the coffee in the bin can result in oxidation and premature staleness.

A modified technique holds the coffee in a holding bin for a shorter period of time and is conventionally utilized in producing soft-brick packaging. The modified technique is only a partial solution that allows for limited de-gassing before packaging. The result is noticeable pillowing of the soft-brick package.

Another known technique to prevent pillowing of a flexible package is to incorporate a one-way valve into a wall of the package. A Goglio valve, similar to that disclosed in U.S. Pat. No. 5,515,994, may be used. The one-way valve has been relatively effective in solving the pillowing problem, but fails to address the second problem.

Independent efforts to solve the second problem include attempts to provide the consumer with a means of easily opening and resealing the package. One method of providing a resealing means is to incorporate a tin-tie into the package. The consumer can reseal the package by folding over the opened end, and securing the tin-tie to prevent unfolding. One drawback to the tin-tie approach is that the folded package and tin-tie do not guarantee a hermetic seal.

Additional packaging material than what would otherwise be needed is also required, both to ensure that adequate material is available for folding the package closed, and for the tin-tie itself.

Another method of providing a resealing means is to incorporate tape into the packaging. Although, the use of tape is somewhat effective, it has disadvantages similar to those of the tin-tie.

Thus, a number of solutions to both problems have been proposed and attempted, but no universal solution has yet been found. A need exists, therefore, for a cost-effective way of solving both problems with a single solution.

SUMMARY OF THE INVENTION

The invention is directed to a cap with a one-way de-gas valve which makes an ideal closure for flexible packaging. The cap includes an outer wall extending downwardly from a top wall. An inner wall also extends downwardly from an inner portion of the top wall, substantially concentrically with the outer wall. The inside surface of the inner wall and the top wall define a cavity with an open bottom and a gas escape path. An insert valve is mounted within the cavity such that a seal is formed between the insert valve and the inside surface of the inner wall. A top surface of the insert valve, the inside surface of the inner wall, and the inner portion of the top wall define a chamber in fluid communication with the gas escape path. A septum is disposed within the chamber, seated on the insert valve and sealing one or more apertures in the insert valve. The septum at least partially unseats from the insert valve in response to an increase in gas pressure within the package acting through the apertures. Unseating of the septum allows gas to pass through the apertures and enter the chamber. In turn, gas in the chamber flows out of the cap into the atmosphere through the escape path. Once pressure on both sides of the insert valve has equalized, the septum reseats, preventing gas from flowing from the chamber back through the apertures.

The outer wall of the cap includes a connection adapted to recloseably mate with a pour spout. The pour spout is provided with a flange adhered to the inside surface of a package. The pour spout extends through the material from which the package is formed, thereby allowing the contents of the package to be removed through the pour spout when the cap is not engaged therewith.

BRIEF DESCRIPTION OF THE DRAWINGS

For the purpose of illustrating the invention, there is shown in the drawings a form which is presently preferred; it being understood, that this invention is not limited to the precise arrangements and instrumentalities shown.

DETAILED DESCRIPTION OF THE PREFERRED EMBODIMENTS

Figure 1:
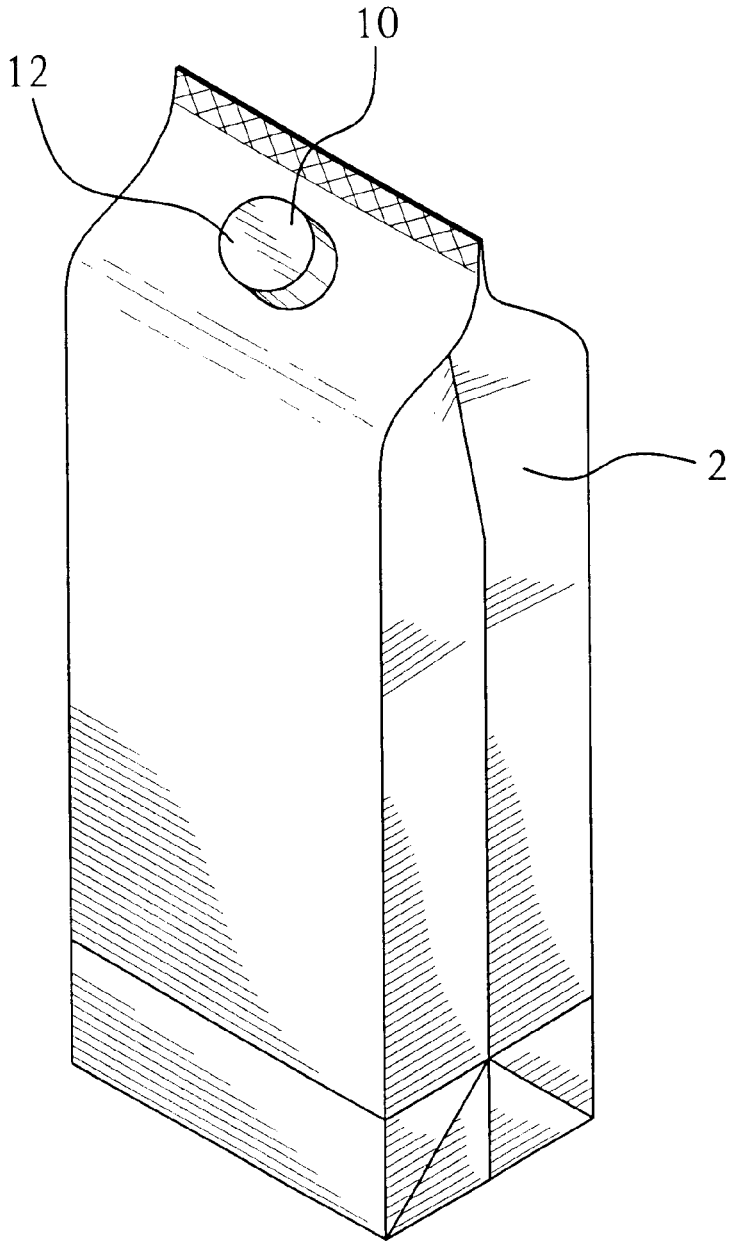
FIG. 1 is an isometric view of a flexible package having a cap with a one-way de-gas feature according to the present invention.

In FIG. 1 there is shown a flexible package 2 with a cap 10 according to the present invention. The cap 10 provides both a means to easily open and reseal the package and a de-gassing feature. It is contemplated that the cap 10 be disposed at or near the top of the package, while the package is in an upright orientation. As used herein, the term top means the highest face or element of an object when disposed in such an upright orientation. For example, the cap 10 is shown to have a top wall 12 in FIG. 1. The terms down, downwardly and the like are relative terms describing the relationship of an element relative to the top face, assuming the object is in an upright orientation without regard to the actual orientation of the object at any particular time.

Figure 2:
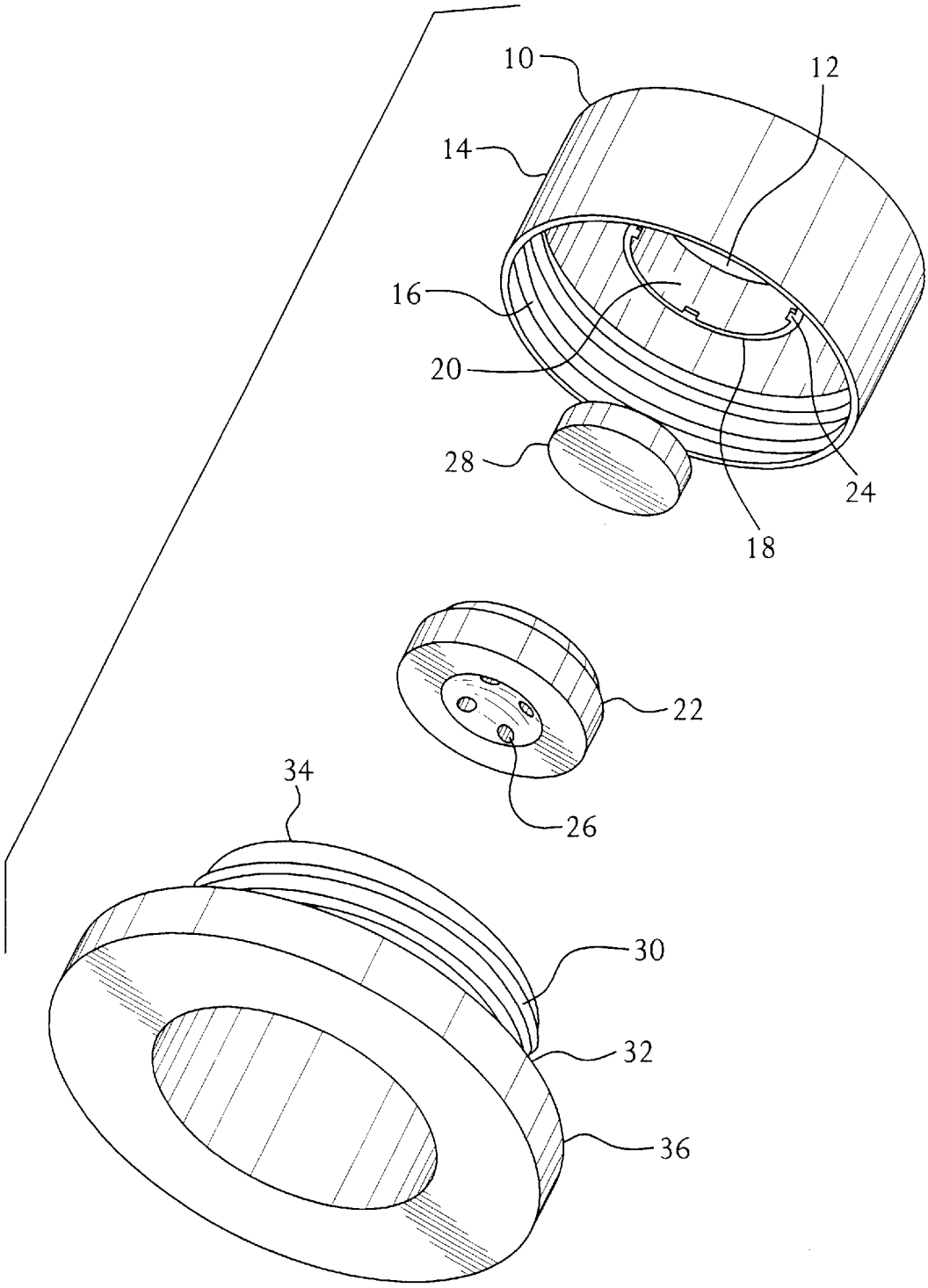
FIG. 2 is an exploded isometric view of a closure including a cap with a one-way de-gas feature according to the present invention.

FIG. 2 is an exploded view of a preferred embodiment of a closure including a cap 10 with a one-way de-gassing feature according to the present invention. The cap 10 includes an outer wall 14 extending downwardly from the top wall 12. (The top wall 12 is substantially obscured from view in FIG. 2, but clearly shown in FIG. 1). The inner surface of the outer wall 14 is provided with threads 16. The cap 10 further includes an inner wall 18 extending downwardly from an inner portion of the top wall 12. The inner wall 18 is concentric with, but not as long as the outer wall 14. Thus, an open-bottom cavity 20 is defined by the inside surface of the inner wall 18 and the top wall 12.

An escape path is provided for gas to flow out of the cavity 20 when the bottom end is sealed. The escape path may be a passage in the top wall 12 (shown as element 42 in FIG. 3). Alternatively, the escape path may be a channel provided down the threads.

An insert valve 22 is adapted to mount in the open-bottom end of the cavity 20 such that a seal is formed between the inner wall 18 and the periphery of the insert valve 22. To properly form the seal, the diameter of insert valve 22 should be substantially the same as the width of cavity 20. Once mounted within cavity 20, the insert valve 22 can be held in place by locking tabs 24. Alternatively, the insert valve can be mounted within the cavity 20 using an appropriate adhesive or securely friction fit into cavity 20 without the aid of the tabs 24. Assembled, the inside surface of the inner wall 18, the inner portion of the top wall 12, and the top surface of the insert valve 22 define a hollow chamber.

One or more apertures 26 are provided in insert valve 22 to allow gas to pass therethrough. A septum 28 is disposed within the chamber defined within the cavity 20 by the top of the insert valve 22, the inside wall 18, and the inner portion of the top wall 12. The septum 28 tends to rest on the top surface of the insert valve 22 and thereby seal the apertures 26. A thin coating of a viscous material, preferably silicone oil (shown as element 40 in FIG. 3), is disposed on the bottom surface of the septum 28 to aid in sealing. The septum 28 is confined within the chamber, but moves or flexes in response to pressure changes acting upon it through apertures 26. The operation of the septum, and more specifically the cooperation of the septum 28, oil layer 40, and insert valve 22, will be more fully explained below with reference to FIG. 3.

The threads 16 of the cap 10 are adapted to engage external threads 30 on a pour spout 32. The pour spout 32 comprises a cylindrical member 34, on which the external threads 30 are located, and a flange 36. The flange 36 is utilized to secure the pour spout 32 to packaging material.

The operation of the cap with a one-way valve will now be described with reference to FIG. 3, which is a cross sectional view of the assembled cap 10 and pour spout 32. The flange 36 is thermowelded or affixed with adhesive to the inside of packaging 38, the thickness of which is exaggerated in FIG. 3 for clarity. Selection of a proper adhesive (not shown) for securing the flange 36 thereto depends upon the particular packaging material selected. Acceptable adhesives and criteria for selection are well known to those skilled in the art. Packaging 38 is preferably a flexible laminate, an ideal laminate being such as that invented by Bray et al. and disclosed in U.S. patent application Ser. No. 09/920,084, filed Aug. 1, 2001, which is assigned to Sonoco Development, Inc. of Hartsville, S.C. and incorporated herein by reference. Other laminates are also known to be acceptable for forming flexible packaging. The cap of the present invention can also be used in connection with rigid plastic or metal containers.

The cylindrical member 34 of the pour spout protrudes through an opening in the packaging material 38 and is open at both its top and bottom. Thus, package contents are free to move out of the package when the cap is removed.

Figure 3:
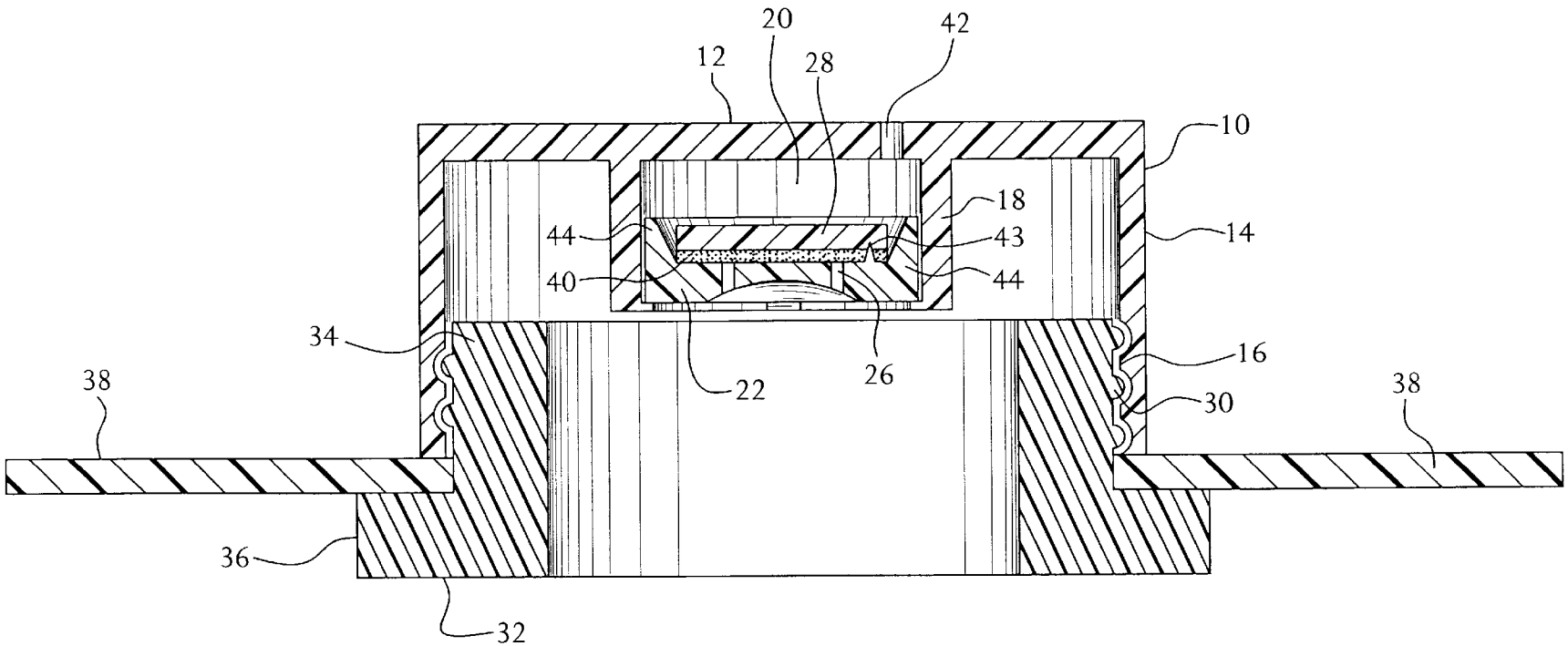
FIG. 3 is a cross-sectional view of a cap with a one-way de-gas feature engaged with a pour spout on a flexible package.

The package is closed when the cap is in place, meaning that the threads 16 and 30 are mated, as shown in FIG. 3. It is contemplated that the package is closed at all relevant times that contents are not being removed from the package. When the package is closed, pressure within the package acts on the septum 28 through apertures 26. Under equalized conditions, the gas pressure within the package is substantially equal to ambient pressure. The equalized condition allows the septum 28 to rest, seated on the top surface of the base of the insert valve 22. A viscous material, which preferably has a high viscosity, such as silicone oil layer 40 is disposed on the bottom surface of septum 28. Alternatively, the oil layer 40 can be disposed on the top surface of the insert valve 22. The oil layer 40 provides an adhesion force that tends to hold the septum in the state of rest, sealing the apertures 26. As gasses are emitted from the packaged product, pressure increases within the package and increased upward force is exerted on the septum 28 through apertures 26. When the exerted force becomes great enough to overcome the adhesion force of the oil layer 40 and any elastic reaction of the septum 28 (where the septum is flexible), the septum at least partially unseats from its resting position (not shown), allowing gas to flow through apertures 26 into the chamber. To a small extent, gravity also influences the amount of pressure required to unseat the septum. However, the affect of gravity on the required pressure depends on the orientation of the cap. As gas enters the chamber, it is, in turn, free to flow to the outside atmosphere through the escape path. As shown in FIG. 3, the escape path is a passage 42 provided in the top wall 12. If the escape path is instead a channel provided down the threads of the cap, an opening near the upper portion of inner wall 18, rather than passage 42, is required.

It is currently contemplated that the septum 28 can be a thin flexible member, the thickness of which is exaggerated in FIGS. 2 and 3. The flexible member can be formed of natural rubber, or any suitably and resiliently flexible rubber-like material, such as silicone. When the septum is in this form, the small affect of gravity is reduced so that the pressure required for unseating of the septum 28 remains substantially constant regardless of the orientation of the cap 10. In addition, the pressure required for unseating is minimized because only a small portion of the septum must unseat to allow gas to escape through one of the apertures 26. Thus, partial unseating of the septum 28 is adequate to relieve pressure within the package. Partial unseating is advantageous over complete unseating because it substantially eliminates the risk of the septum 28 becoming permanently dislodged and failing to properly reseal the apertures 26 once pressure equalization is achieved.

In one embodiment of the invention, at least one imperfection 43 is formed in the insert valve 22 for locally interfering with the adhesion force. The imperfection 43 may be formed in a variety of shapes, but is shown as an inverted cone member in FIG. 3. For clarity, the size of the imperfection 43 is exaggerated, as is the width of oil layer 40 through which the imperfection extends. As shown, the imperfection 43 can impinge slightly into the space that would otherwise be occupied by the septum 28 if seated flush. A point of weakness is thereby created in the adhesion force, which is otherwise substantially uniform across the entire bottom surface of septum 28, provided by the oil layer 40. The point of weakness in the adhesion force permits the septum 28 to partially unseat when acted upon by lesser internal pressure than would otherwise be necessary for unseating. However, to ensure that a proper seal is formed while the septum 28 is seated, it is recommended that the imperfection 43 not exceed about 1 millimeter in height.

To form the seal between the insert valve 22 and the inner wall 18, the insert valve 22 is provided with a peripheral member 44 extending upwardly from the base of the insert valve 22. The peripheral member 44 preferably has a frusto-conical inside surface with its narrowest portion at the base of insert valve 22. The shape of the inside surface facilitates initial placement and proper reseating of the septum 28 if it unseats entirely, whether a flexible or rigid septum is used. Thus, as the septum 28 seats on top of the base of the insert valve 22, it is guided into position by the frusto-conical surface to ensure that all apertures 26 become sealed.

As previously observed, the present invention can be used with many types of packaging, both flexible and rigid. However, it is contemplated that flexible packaging for gas-emitting foodstuffs, such as coffee, gains the most benefit from the features of the present invention. Specifically, it should be obvious in light of the foregoing that both of the problems of providing packaging with means for easy opening and resealing and of preventing the build-up of gasses emitted from a product are solved by providing a single structure. It should also be noted that packages incorporating the invention can be produced in any desired shape, and the invention is, therefore, not limited to the embodiment shown.

Thus, the present invention may be embodied in other specific forms without departing from the spirit or essential attributes thereof and, accordingly, reference should be made to the appended claims, rather than to the foregoing specification, as indicating the scope of the invention.

What is claimed is:

1. A cap for mating with a pour spout on a flexible package in order to close the package, the cap comprising:

a top wall;

an outer wall extending downwardly from the top wall and having a connection adapted to recloseably mate with the pour spout;

an inner wall extending downwardly from an inner portion of the top wall substantially concentrically with the outer wall;

the inner wall and the inner portion of the top wall defining a cavity with an open bottom and a gas escape path;

an insert valve mounted within a bottom of the cavity forming a seal with the inner wall, the insert valve having one or more apertures extending therethrough, a top surface of the insert valve, the inner wall, and the inner portion of the top wall defining a chamber within the cavity, the chamber being in fluid communication with the gas escape path;

a septum seated flush on the top surface of the insert valve within the chamber and flush with and sealing the apertures, the septum adapted to at least partially unseat from the insert valve in response to an increase in gas pressure within the package and reseat on the insert valve when pressure on both sides of the insert valve equalizes.

2. The cap of claim 1 wherein the septum comprises a flexible member.

3. The cap of claim 2 further comprising a layer of viscous material disposed between the insert valve and the septum.

4. The cap of claim 3 wherein the viscous material is silicone oil.

5. A cap for mating with a pour spout on a flexible package in order to close the package, the cap comprising:

a top wall;

an outer wall extending downwardly from the top wall and having a connection adapted to recloseably mate with the pour spout;

an inner wall extending downwardly from an inner portion of the top wall substantially concentrically with the outer wall;

the inner wall and the inner portion of the top wall defining a cavity with an open bottom and a gas escape path;

an insert valve mounted within a bottom of the cavity forming a seal with the inner wall, the insert valve having one or more apertures extending therethrough, a top surface of the insert valve, the inner wall, and the inner portion of the top wall defining a chamber within the cavity, the chamber being in fluid communication with the gas escape path;

a rigid septum seated flush on the top surface of the insert valve within the chamber and flush with and sealing the apertures, the septum adapted to at least partially unseat from the insert valve in response to an increase in gas pressure within the package and reseat on the insert valve when pressure on both sides of the insert valve equalizes.

6. The cap of claim 5 further comprising a layer of viscous material disposed between the insert valve and the septum.

7. The cap of claim 1 wherein the gas escape path comprises a passage in the top wall.

8. A cap for mating with a pour spout on a flexible package in order to close the package, the cap comprising:

a top wall;

an outer wall extending downwardly from the top wall and having a connection adapted to recloseably mate with the pour spout;

an inner wall extending downwardly from an inner portion of the top wall substantially concentrically with the outer wall;

the inner wall and the inner portion of the top wall defining a cavity with an open bottom and a gas escape path;

an insert valve mounted within a bottom of the cavity forming a seal with the inner wall, the insert valve comprising a base and an upwardly extending peripheral member having a frusto-conical inside surface, narrowest at the base and having one or more apertures extending therethrough, a top surface of the insert valve, the inner wall, and the inner portion of the top wall defining a chamber within the cavity, the chamber being in fluid communication with the gas escape path;

a septum seated on the top surface of the insert valve within the chamber and sealing the apertures, the septum adapted to at least partially unseat from the insert valve in response to an increase in gas pressure within the package and reseat on the insert valve when pressure on both sides of the insert valve equalizes.

9. A cap for mating with a pour spout on a flexible package in order to close the package, the cap comprising:

a top wall;

an outer wall extending downwardly from the top wall and having a connection adapted to recloseably mate with the pour spout;

an inner wall extending downwardly from an inner portion of the top wall substantially concentrically with the outer wall;

the inner wall and the inner portion of the top wall defining a cavity with an open bottom and a gas escape path;

an insert valve mounted within a bottom of the cavity forming a seal with the inner wall, the insert valve comprising one or more apertures extending therethrough and an imperfection protruding upwardly from a top surface, the top surface of the insert valve, the inner wall, and the inner portion of the top wall defining a chamber within the cavity, the chamber being in fluid communication with the gas escape path;

a septum seated flush on the top surface of the insert valve within the chamber and flush with and sealing the apertures, the septum adapted to at least partially unseat from the insert valve in response to an increase in gas pressure within the package and reseat on the insert valve when pressure on both sides of the insert valve equalizes.

10. A cap with a one-way de-gas valve, the cap comprising:

an outer wall with a recloseable connection extending downwardly from a top wall;

an inner wall extending downwardly from an inner portion of the top wall, an inside surface of the inner wall and the inner portion of the top wall defining a cavity with an open bottom and a gas escape path;

an insert valve mounted within the cavity, the insert valve forming a seal with the inside surface of the inner wall and having an upper surface, the upper surface, the inside surface, and the inner portion defining a chamber in fluid communication with the gas escape path;

a flexible solid septum disposed within said chamber, the septum seated flush on the insert valve and sealing one or more apertures in the insert valve; and a viscous material disposed between the septum and the insert valve, the viscous material exerting an adhesion force tending to maintain the septum seated on the insert valve such that the apertures are sealed;

the septum being capable of at least partially unseating in response to gas pressure acting through the apertures and exerting a force greater than the adhesion force.

11. The cap of claim 10 wherein the gas escape path comprises a passage defined within the top wall.

12. A cap with a one-way de-gas valve, the cap comprising:

an outer wall with a recloseable connection extending downwardly from a top wall;

an inner wall extending downwardly from an inner portion of the top wall, an inside surface of the inner wall and the inner portion of the top wall defining a cavity with an open bottom and a gas escape path;

tabs extending inwardly from the inside surface of the inner wall;

an insert valve mounted within the cavity, the tabs holding the insert valve within the cavity, the insert valve forming a seal with the inside surface of the inner wall and having an upper surface, the upper surface, the inside surface, and the inner portion defining a chamber in fluid communication with the gas escape path;

a flexible septum disposed within said chamber, the septum seated flush on the insert valve and sealing one or more apertures in the insert valve; and a viscous material disposed between the septum and the insert valve, the viscous material exerting an adhesion force tending to maintain the septum seated on the insert valve such that the apertures are seal;

the septum being capable of at least partially unseating in response to gas pressure acting through the apertures and exerting a force greater than the adhesion force.

13. The cap of claim 10 wherein the insert valve is mounted within the cavity via a friction fit.

14. The cap of claim 10 wherein the adhesion force is substantially uniform across a bottom surface of the septum and the insert valve comprises a base having an imperfection protruding upwardly to create an area of weakness in the otherwise substantially uniform adhesion force.

15. The cap of claim 14 wherein the insert valve further comprises a peripheral member extending upwardly from the base and having a frusto-conical inside surface, the frusto-conical surface being narrowest at the base, and the seal between the insert valve and the inside surface of the inner wall being formed with the peripheral member of the insert valve.

16. A resealable closure and package containing gas-emitting products, the closure comprising:

a cap including, an outer wall extending downwardly from a top wall, the outer wall including a connection adapted to mate with a complementary connection on a pour spout, an inner wall extending downwardly from an inner portion of the top wall, the inner wall having an inside surface, the inside surface and the inner portion of the top wall defining a cavity with an open end and a gas escape path, an insert valve mounted at the open end of the cavity, the insert valve including, a base with one or more apertures extending from the open end of the cavity to outside the cavity, and a peripheral portion adapted to form a seal with the inside surface of the inner wall, the insert valve, the inner wall, and the inner portion of the top wall defining a chamber within the cavity, the chamber being in fluid communication with the gas escape path, and a septum disposed within said chamber, the septum seated flush on the base of the insert valve and sealing the one or more apertures in the base of the insert valve, the septum being capable of at least partially unseating in response to increased gas pressure outside of the chamber acting through the apertures; and a pour spout attached to the package, the pour spout including, a hollow cylindrical member protruding through an opening in the package, the cylindrical member being open to contents within the package at an inner end and open to the outside of the package at an outer end, the cylindrical member having a connection for receiving the cap at the outer end, and a flange extending radially from the inner end of the cylindrical member, the flange being adhered to the inside of the package.

17. The resealable closure and package of claim 16 wherein the escape path comprises a passage in the inner portion of the top wall.

18. The resealable closure and package of claim 16 further comprising a layer of viscous material disposed between the septum and the insert valve and providing an adhesion force therebetween.

19. The resealable closure and package of claim 18 wherein the insert valve further comprises an imperfection locally interfering with the adhesion force.

* * * * *